US010391367B2

(12) United States Patent
Chen et al.

(10) Patent No.: US 10,391,367 B2
(45) Date of Patent: Aug. 27, 2019

(54) ADJUSTABLE SOLE WEIGHT OF A GOLF CLUB HEAD

(71) Applicant: KARSTEN MANUFACTURING CORPORATION, Phoenix, AZ (US)

(72) Inventors: Xiaojian Chen, Phoenix, AZ (US); Eric J. Morales, Laveen, AZ (US); Martin R. Jertson, Cave Creek, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 16/001,859

(22) Filed: Jun. 6, 2018

(65) Prior Publication Data

US 2018/0280771 A1 Oct. 4, 2018

Related U.S. Application Data

(63) Continuation of application No. 15/135,432, filed on Apr. 21, 2016, now Pat. No. 10,004,954, and a (Continued)

(51) Int. Cl.

| | |
|---|---|
| ***A63B 53/06*** | (2015.01) |
| ***A63B 53/04*** | (2015.01) |
| *A63B 53/00* | (2015.01) |

(52) U.S. Cl.

CPC ..... *A63B 53/0466* (2013.01); *A63B 53/04* (2013.01); *A63B 53/047* (2013.01); *A63B 53/0487* (2013.01); *A63B 2053/005* (2013.01); *A63B 2053/0433* (2013.01); *A63B 2053/0491* (2013.01)

(58) Field of Classification Search

CPC . A63B 53/0466; A63B 53/04; A63B 53/0487; A63B 53/047; A63B 2053/005; A63B 2053/0433; A63B 2053/0491

See application file for complete search history.

(56) References Cited

U.S. PATENT DOCUMENTS 1,133,129 A * 3/1915 Govan ..... A63B 53/0466 473/337

1,518,316 A 12/1924 Ellingham (Continued)

FOREIGN PATENT DOCUMENTS

| | | |
|---|---|---|
| GB | 2195546 | 4/1988 |
| JP | 2006000435 | 1/2006 |
| TW | 1260991 | 9/2006 |

OTHER PUBLICATIONS

International Search Report and Written Opinion of the International Search Authority for International Patent Application No. PCT/US2013/063191 filed Feb. 28, 2014.

*Primary Examiner* — Stephen L Blau

(57) ABSTRACT

A golf club head includes a body having a heel portion, a toe portion, a sole portion, and an outer surface, a strikeface having a geometric center, a head center of gravity, and a weight member including a weight pad. The weight member is configured to be repositionable by the user to a first position or a second position. The club head having the weight member in the first position shifts the head center of gravity toward the strikeface, and the club head having the weight member in the second position shifts the head center of gravity away from the strikeface.

9 Claims, 10 Drawing Sheets

Related U.S. Application Data continuation-in-part of application No. 14/859,104, filed on Sep. 18, 2015, now Pat. No. 9,737,772, which is a continuation of application No. 13/955,644, filed on Jul. 31, 2013, now Pat. No. 9,162,120.

(60) Provisional application No. 62/150,921, filed on Apr. 22, 2015, provisional application No. 61/717,262, filed on Oct. 23, 2012.

(56) References Cited

U.S. PATENT DOCUMENTS 1,840,924 A 1/1932 Tucker
2,163,091 A 6/1939 Held
2,954,231 A 9/1960 MacIntyre
3,143,349 A 8/1964 MacIntyre
3,419,275 A 12/1968 Winkleman
3,556,533 A 1/1971 James
3,652,094 A 3/1972 Cecil
3,692,306 A 9/1972 Cecil
3,961,796 A 6/1976 Thompson
3,979,123 A 9/1976 Belmont
4,085,934 A 4/1978 Churchward
4,411,430 A * 10/1983 Dian ..... A63B 53/007 473/337
4,423,874 A 1/1984 Stuff, Jr.
4,754,977 A 7/1988 Sahm
4,869,507 A 9/1989 Sahm
4,944,515 A 7/1990 Shearer
5,050,879 A 9/1991 Sun et al.
5,058,895 A 10/1991 Igarashi
5,082,278 A 1/1992 Hsien
5,244,210 A 9/1993 Au
5,246,227 A 9/1993 Sun et al.
5,431,401 A 7/1995 Smith
5,439,222 A 8/1995 Kranenberg
5,489,097 A 2/1996 Simmons
5,533,730 A 7/1996 Ruvang
5,570,886 A 11/1996 Rigal et al.
5,571,053 A 11/1996 Lane
5,643,110 A 7/1997 Igarashi
5,669,827 A 9/1997 Nagamoto
5,683,309 A 11/1997 Reimers
5,769,737 A 6/1998 Holladay et al.
5,795,245 A 8/1998 Chang et al.
6,059,669 A 5/2000 Pearce
6,102,813 A 8/2000 Dill
6,206,790 B1 3/2001 Kubica et al.
6,254,494 B1 7/2001 Hasebe et al.
6,270,422 B1 8/2001 Fisher
6,306,048 B1 10/2001 McCabe et al.
6,348,014 B1 2/2002 Chiu
6,409,612 B1 6/2002 Evans et al.
6,485,375 B1 11/2002 McKinley
6,749,523 B1 6/2004 Forzano
6,926,615 B1 8/2005 Souza et al.
6,964,617 B2 11/2005 Williams
7,048,639 B2 5/2006 Grace
7,083,530 B2 8/2006 Wahl et al.
7,153,215 B2 12/2006 Peterson et al.
7,153,220 B2 * 12/2006 Lo ..... A63B 53/04 473/335
7,198,575 B2 4/2007 Beach et al.
7,556,567 B2 * 7/2009 Galloway ..... A63B 53/02 473/224
7,588,502 B2 9/2009 Nishino
7,594,865 B2 9/2009 Ines
7,611,424 B2 11/2009 Nagai et al.
7,670,232 B2 3/2010 Franklin et al.
7,670,235 B2 3/2010 Lo
7,682,263 B2 3/2010 Yamamoto
7,744,485 B2 6/2010 Jones et al.
7,771,291 B1 8/2010 Willett et al.
7,824,277 B2 11/2010 Bennett et al.
7,824,280 B2 11/2010 Yokota
7,887,432 B2 2/2011 Jones et al.
7,934,999 B2 5/2011 Cackett et al.
8,016,694 B2 9/2011 Llewellyn et al.
8,197,358 B1 * 6/2012 Watson ..... A63B 53/0466 473/334
8,202,115 B2 6/2012 Suzuki et al.
8,202,175 B2 6/2012 Ban
8,425,348 B2 4/2013 Boyd
9,421,432 B2 8/2016 Galvan et al.
2002/0032075 A1 3/2002 Vatsvog
2002/0137576 A1 9/2002 Dammen
2006/0030420 A1 2/2006 Roake
2006/0058112 A1 3/2006 Haralason et al.
2006/0178229 A1 8/2006 Liang et al.
2007/0129164 A1 6/2007 Shimazaki et al.
2007/0135231 A1 6/2007 Lo
2007/0149315 A1 6/2007 Bennett et al.
2008/0146369 A1 6/2008 Wahl et al.
2009/0118034 A1 * 5/2009 Yokota ..... A63B 53/04 473/338
2010/0075774 A1 3/2010 Ban
2010/0144461 A1 6/2010 Ban
2013/0109501 A1 5/2013 Stites et al.
2013/0190100 A1 7/2013 Oldknow et al.

* cited by examiner

ADJUSTABLE SOLE WEIGHT OF A GOLF CLUB HEAD

CROSS-REFERENCE TO RELATED APPLICATIONS

This is a continuation of U.S. patent application Ser. No. 15/135,432, filed on Apr. 21, 2016, which is a continuation in part of U.S. patent application Ser. No. 14/859,104, filed on Sep. 18, 2015, which is a continuation of U.S. patent application Ser. No. 13/955,644, filed on Jul. 31, 2013, now U.S. Pat. No. 9,162,120, which claims priority to U.S. Provisional Patent Application No. 61/717,262, filed on Oct. 23, 2012. U.S. patent application Ser. No. 15/135,432, filed on Apr. 21, 2016 further claims priority to U.S. Provisional Patent Application No. 62/150,921, filed on Apr. 22, 2015. The contents of all of the above-described applications are incorporated by reference in their entirety.

FIELD OF INVENTION

The present disclosure relates to golf club heads. In particular, the present disclosure is related to an adjustable weight system for golf club heads.

BACKGROUND

Various characteristics of a golf club can affect the performance of the golf club. For example, the center of gravity and the moment of inertia of the golf club head of the golf club are characteristics that can affect performance.

The center of gravity and moment of inertia of the golf club head are functions of the distribution of mass of the golf club head. In particular, distributing mass of the club head to be closer to a sole portion of the club head, closer to a strikeface of the club head, and/or closer to a toe portion and heel portion of the club head can alter the center of gravity and/or the moment of inertia of the club head. Altering the moment of inertia of the club head can alter the forgiveness of the golf club, flight direction of the golf ball, and/or flight angle of the golf ball. Increasing the flight angle of a golf ball can increase the distance the golf ball travels.

Figure 1:
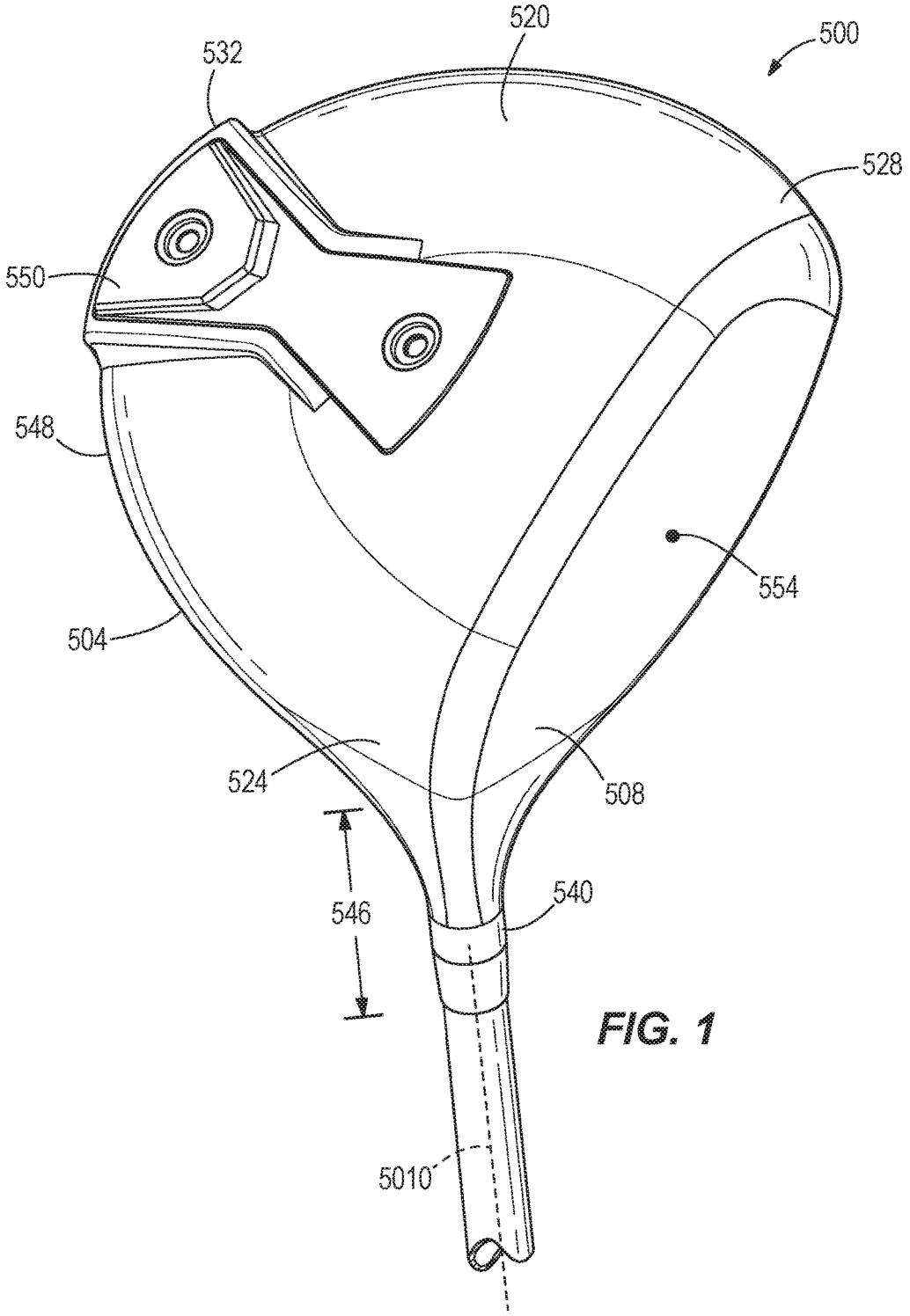
FIG. 1 illustrates a perspective view of an embodiment of a golf club head having a weight member.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

DETAILED DESCRIPTION

The inventors have discovered a weight system for a golf club head that allows users to change the position of weight within the sole portion of a club head to achieve different performance characteristics of the golf club for different courses or holes. For example, the user may position the weight such that the center of gravity position is shifted toward the strikeface or away from the strikeface to generate different vertical spin rates on the golf ball. Further, the weight system is designed to be flush with the sole portion of the club head to maintain the aerodynamic properties of the club head.

In one embodiment, a golf club head includes a body having a heel portion, a toe portion, a sole portion, and an outer surface, a strikeface having a geometric center, a head center of gravity, and a weight member including a weight pad. The weight member is configured to be positioned adjacent to the sole portion of the club head, substantially flush with the outer surface of the body. The weight member is repositionable by the user to a first position or a second position, wherein the club head having the weight member in the first position shifts the head center of gravity toward the strikeface, and the club head having the weight member in the second position shifts the head center of gravity away from the strikeface. On impact with a golf ball at the geometric center of the strikeface, the club head having the weight member in the first position applies a first vertical spin on the golf ball and the club head having the weight member in the second position applies a second vertical spin on the golf ball such that the second vertical spin is different than the first vertical spin.

In another embodiment, a golf club head includes a body having a heel portion, a toe portion, a sole portion, and an outer surface, a strikeface having a geometric center, a head center of gravity, and a weight member. The weight member has opposing first and second edges and includes a weight member axis and a geometric center, the weight member axis intersects the first and second edges and the geometric center. A width of the weight member in a direction taken orthogonal to the weight member axis increases along the weight member axis from the geometric center towards the first and second edges.

In another embodiment, a golf club head includes a body having a heel portion, a toe portion, a sole portion, and an outer surface, a strikeface having a geometric center, a rear portion opposite the strikeface, a head center of gravity, a club head axis that extends through the head center of gravity from the strikeface to the rear portion, and a weight member. The weight member including a weight pad, and the weight pad having a center of gravity. The weight member is configured to be positioned adjacent to the sole portion of the club head in one of a first position or a second position. The position of the weight pad center of gravity changes in relation to the strikeface between the first and second positions. A weight pad axis, which is fixed with respect to the club head axis, extends through the weight pad center of gravity when the weight member is in the first position and when the weight member is in the second position. The weight pad axis and the club head axis form a weight pad angle that ranges from 0 degrees to 20 degrees.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The absence of the word "removably," "removable," and the like near the word "coupled," and the like does not mean that the coupling, etc. in question is or is not removable.

The term "perpendicular distance" refers to the distance between a point and an axis or a plane, wherein a line extending from the point to the axis or the plane is positioned at a perpendicular angle to the axis or plane, respectively.

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and of being practiced or of being carried out in various ways.

FIGS. 1-6 illustrate an embodiment of a golf club head 500 that includes a removable and adjustable weight member 550. With specific reference to FIGS. 1-2, the golf club head 500 includes a body 504, a strikeface 508, and a head center of gravity 512. The body 504 includes a sole portion 520, a crown portion 522 (shown in FIG. 3) opposite the sole portion 520, a heel portion 524, a toe portion 528 opposite the heel portion 524, a rear portion 532 opposite the strikeface 508, and a hosel 540. The hosel 540 includes a hosel axis 5010 extending along a length 546 and through a center of the hosel 540. The body 504 further includes an inner surface (not shown), an outer surface 548, and a weight member 550.

Figure 3:
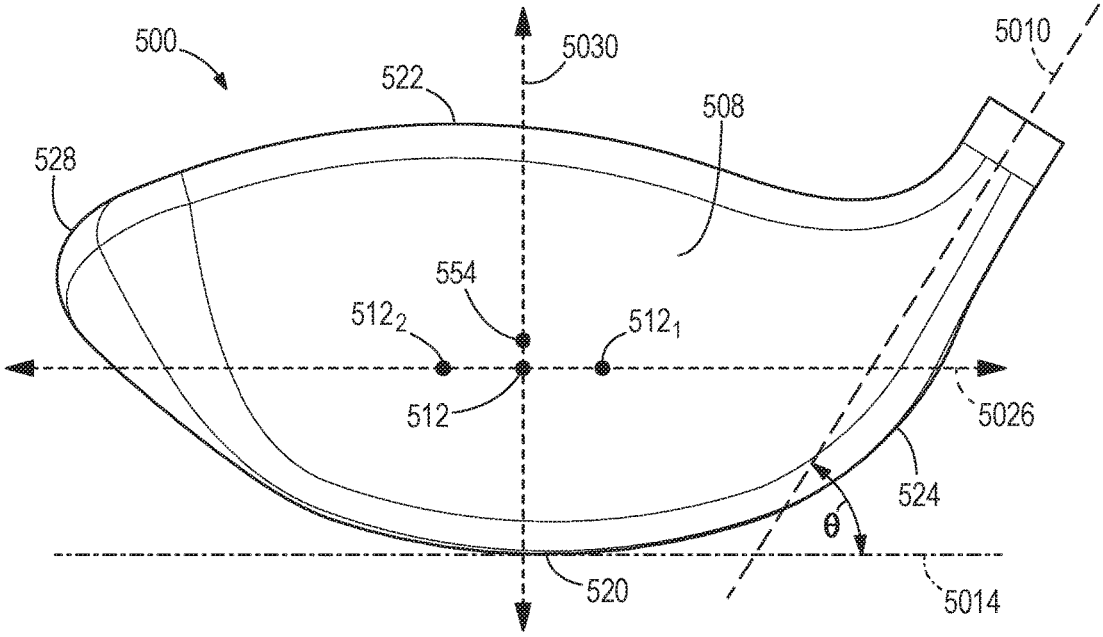
FIG. 3 illustrates a front view of the golf club head of FIG. 1.
Figure 4:
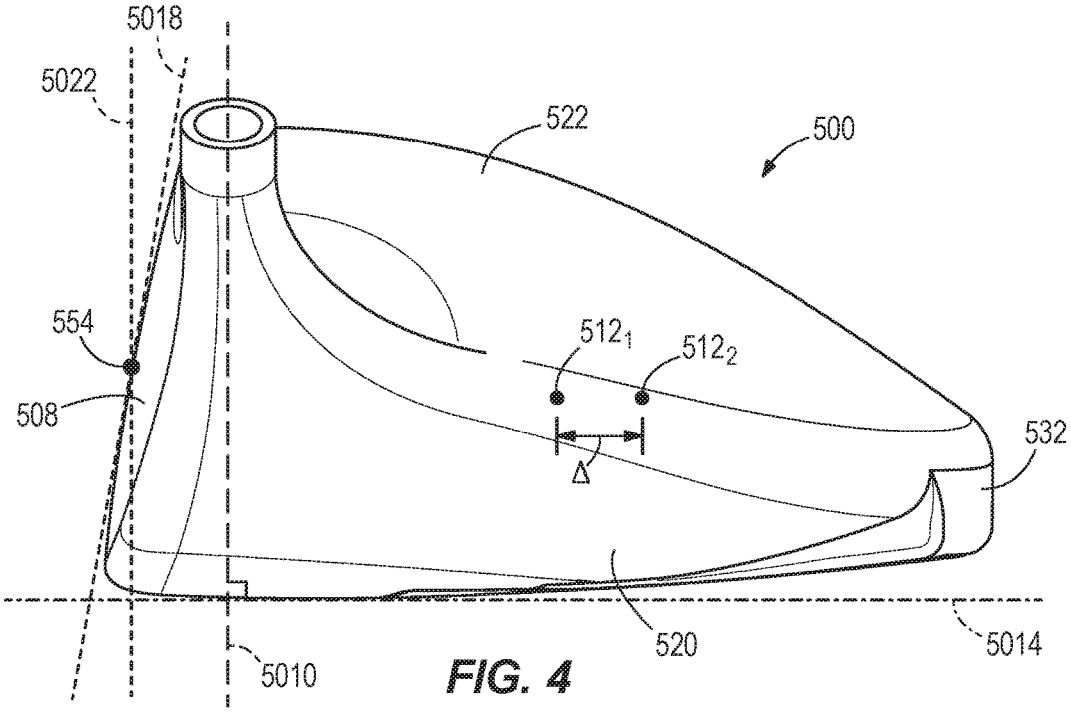
FIG. 4 illustrates a side view of the golf club head of FIG. 1.

FIGS. 3-4 illustrate the club head at an address position relative to a ground plane 5014. As shown in FIG. 3, the hosel axis 5010 is positioned at an angle θ to the ground plane 5014 with respect to a front view of the club head. In the illustrated embodiment, the angle θ is approximately 60 degree. However, in other embodiments, angle θ can be any suitable angle (i.e., any suitable golf club lie angle) including 45 degrees, 50 degrees, 55 degrees, 60 degrees, 65 degrees, 70 degrees, 75 degrees, or any other increment of degrees between 45 degrees and 75 degrees. Referring now to FIG. 4, the hosel axis 5010 is substantially orthogonal to the ground plane 5014 with respect to a side view of the club head. The strikeface 508 of the club head defines a loft plane 5018 tangent to a geometric center 554 of the strikeface 508, and a front plane 5022 extending through the geometric center 554 of the strikeface 508, orthogonal to the ground plane 5014 when the club head is at the address position.

Figure 2:
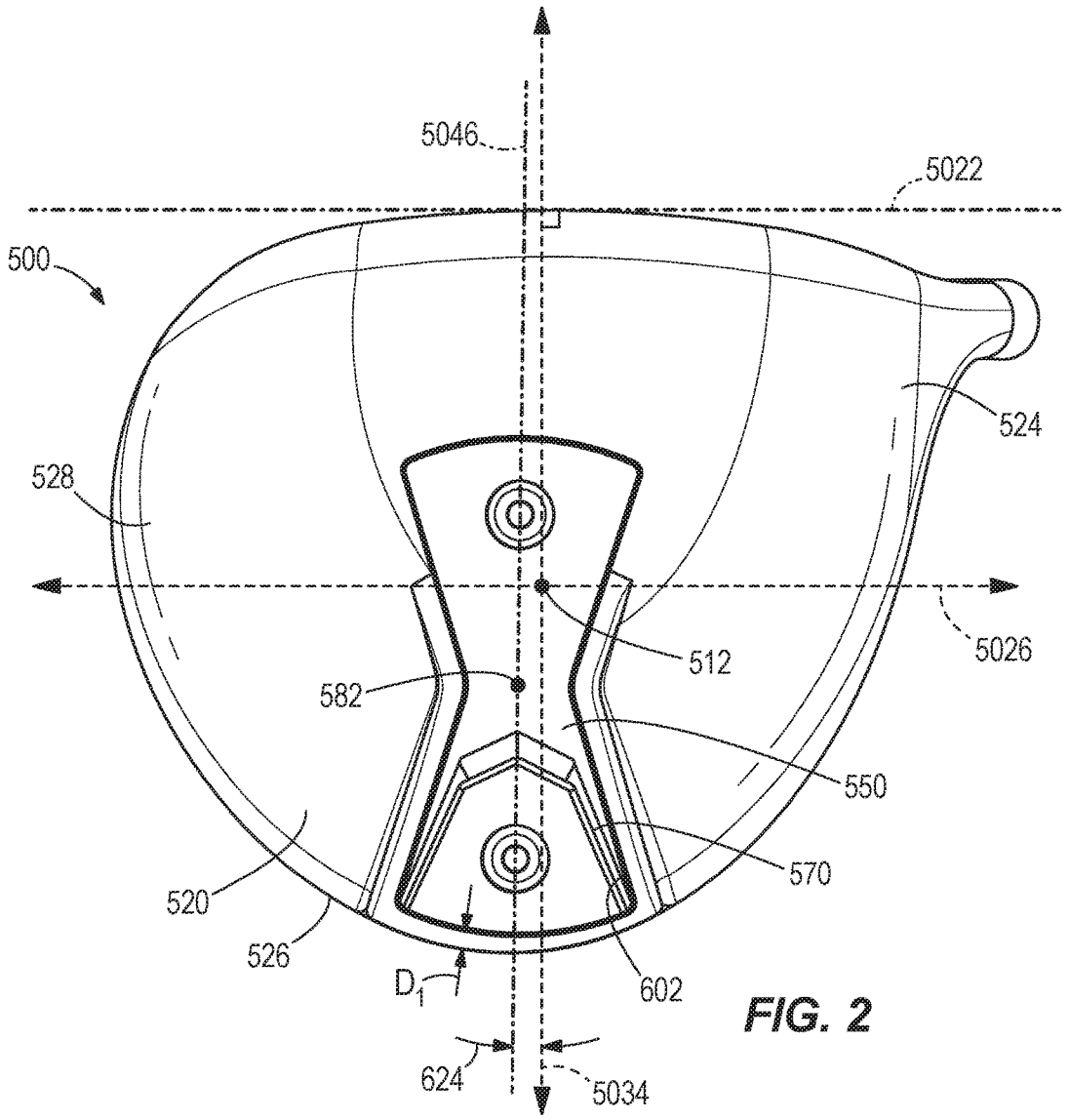
FIG. 2 illustrates a sole view of the golf club head of FIG. 1.

Referring to FIGS. 2-4, the head center of gravity 512 defines an origin of a coordinate system including an x-axis 5026, a y-axis 5030, and a z-axis 5034, wherein the x-axis 5026, the y-axis 5030, and the z-axis 5034 are perpendicular to each other. The x-axis 5026 extends through the head center of gravity 512 from the heel portion 524 to the toe portion 528 of the club head 500, parallel to the front plane 5022. The y-axis 5030 extends through the head center of gravity 512 from the crown portion 522 to the sole portion 520 of the club head 500, parallel to the front plane 5022. The z-axis 5034 extends through the head center of gravity 512 from the strikeface 508 to the rear portion 532 of the club head 500, orthogonal to the front plane 5022.

Figure 5:
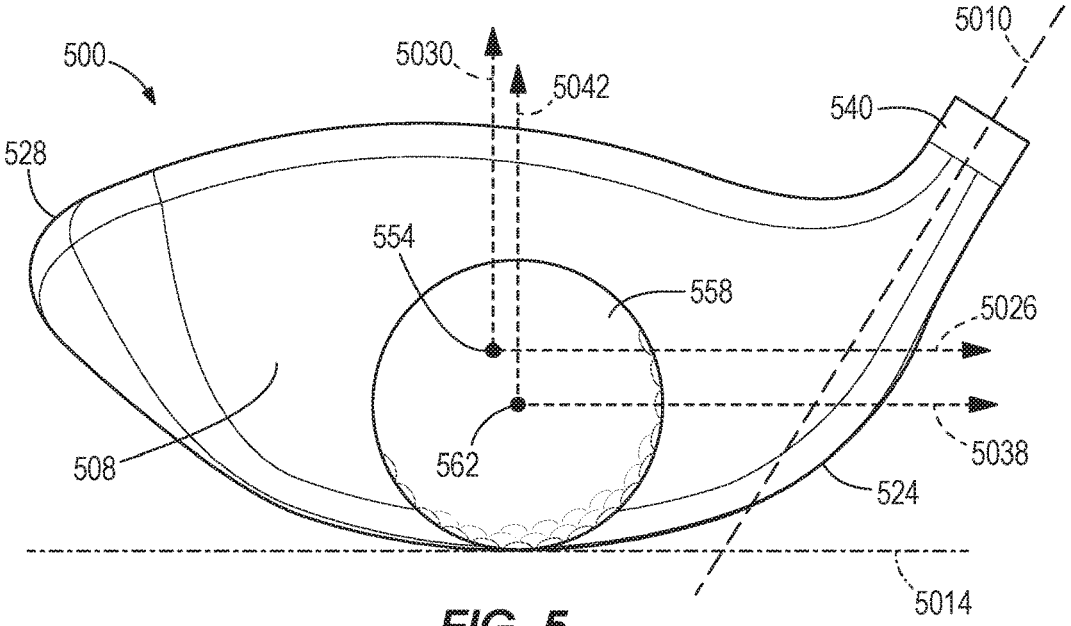
FIG. 5 illustrates a front view of the golf club head of FIG. 1 with a golf ball at an address position prior to impact with the golf club head.

Referring to FIG. 5, the club head 500 can impact a golf ball 558 positioned adjacent to the ground plane 5014, shown at an address position. The golf ball 558 includes a ball center of gravity 562, a first axis 5038 extending through the ball center of gravity 562 parallel to the x-axis 5026 of the club head 500 when the golf ball 558 is at the address position, and a second axis 5042 extending through the ball center of gravity 562 parallel to the y-axis 5030 of the club head 500 when the golf ball 558 is at the address position.

Figure 6:
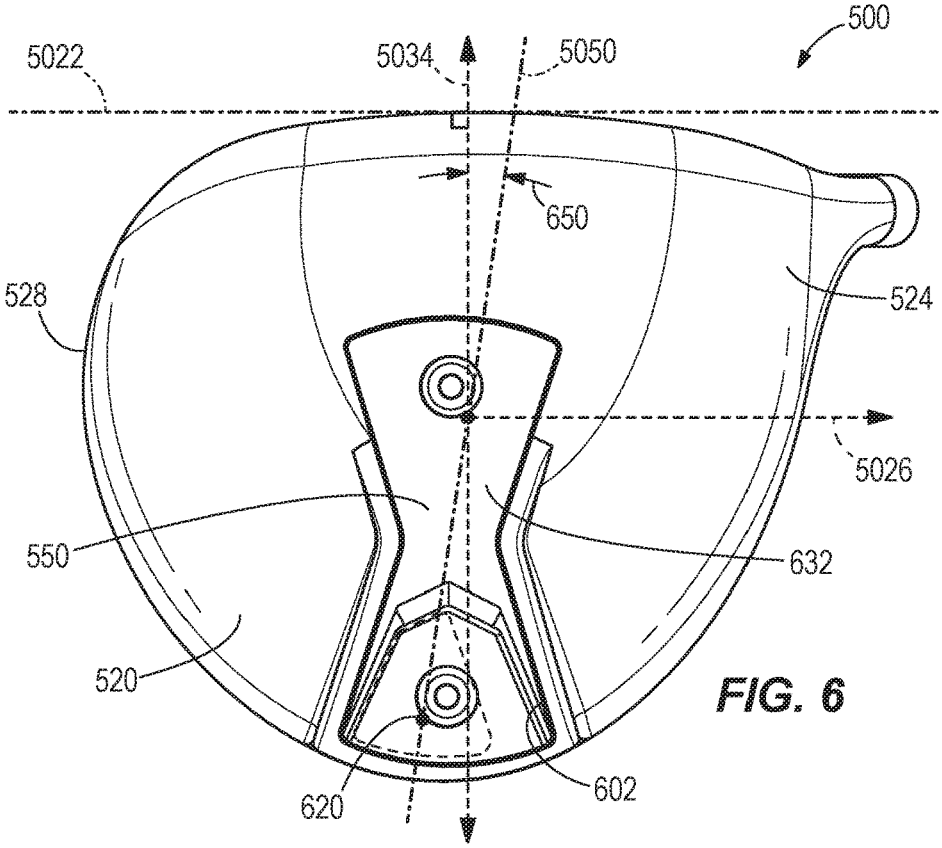
FIG. 6 illustrates another sole view of the golf club head of FIG. 1 with the weight member positioned in a second position and the weight pad shown in broken lines.
Figure 7:
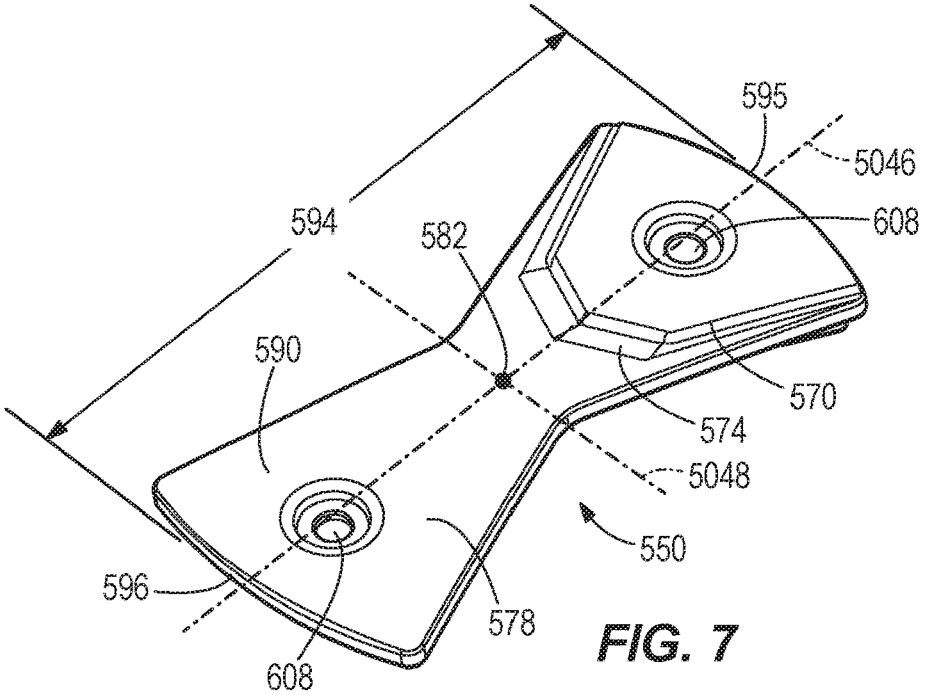
FIG. 7 illustrates a perspective view of a second side of the weight member of FIG. 1.
Figure 8:
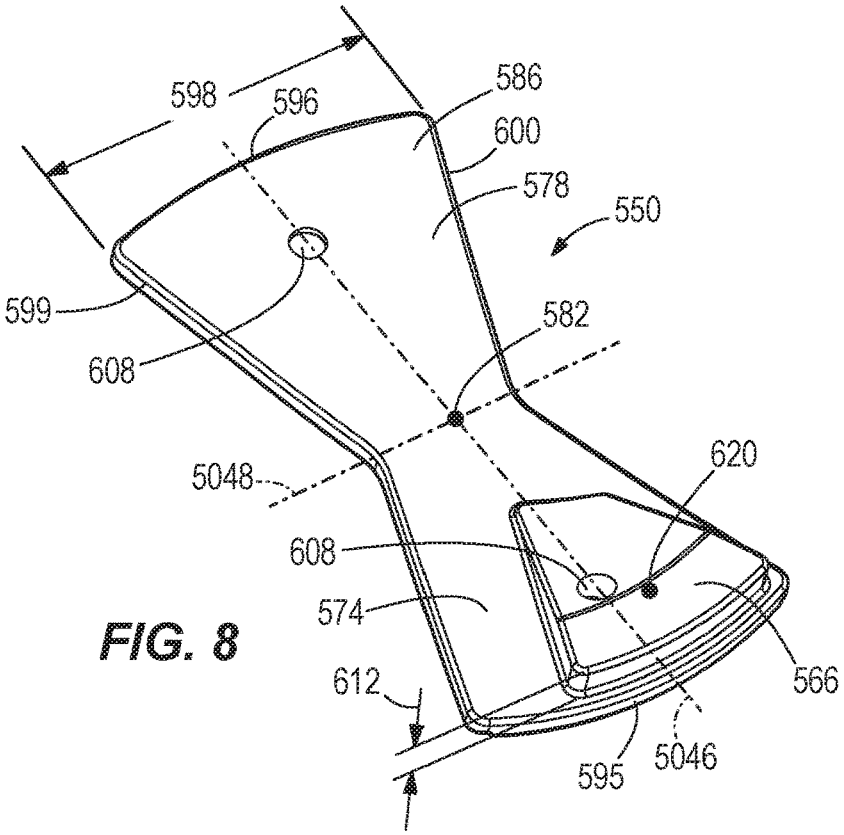
FIG. 8 illustrates a perspective view of a first, opposite side of the weight member of FIG. 7.

Referring to FIGS. 7-8, the weight member 550 includes a weight pad 566 (shown in FIG. 8), an indicator 570 (shown in FIG. 7), a first portion 574, and a second portion 578. The weight member 550 further includes a geometric center 582, a first side 586 (shown in FIG. 8), a second side 590 (shown in FIG. 7), a length 594, and a width 598. The length 594 extends from a first edge 595 to a second, opposite edge 596 of the weight member 550. A weight member axis 5046 extends along the length 594 and through (or intersects) the geometric center 582 of the weight member 550. The width 598 extends from a first side edge 599 to a second, opposite side edge 600 of the weight member 550. A second weight member axis 5048 extends along the width 598, is orthogonal to the weight member axis 5046, and extends through (or intersects) the geometric center 582. The weight member 550 is configured to be removably received by and positionable within a cavity 602 (shown in FIG. 6) located on the outer surface 548 of the sole portion 520 of the club head 500.

The weight member 550 includes a plurality of apertures or through-holes 608. A first through-hole 608 is positioned in the first portion 574, while a second through-hole 608 is positioned in the second portion 578. The through-holes 608 are each configured to receive a fastener (not shown) to facilitate a connection of the weight member 550 with the club head 500, which is discussed in additional detail below. In other embodiments, the weight member 550 can include a single through-hole 608 or three or more through-holes 608.

The first and second portions 574, 578 that define the weight member 550 are generally symmetrical when taken along the weight member axis 5046 as an axis of symmetry. In addition, the first and second portions 574, 578 are generally symmetrical when taken along the second weight member axis 5048 as an axis of symmetry. The first and second portions 574, 578 form a unitary member (or are permanently coupled).

The weight member 550 has a shape to minimize mass at the geometric center 582, and increase mass at the opposing edges 595, 596. As such, the weight member 550 has an increasing width 598 along the weight member axis 5046 with increasing distance from (or the greater the distance away from) the geometric center 582 (i.e., from the geometric center 582 towards the first and/or second edges 595, 596). More specifically, the width 598 taken through the geometric center 582 (along the second weight member axis 5048) is less than the widths 598 taken along the weight member axis 5046 on the first portion 574 and the second portion 578. The widths 598 taken along the weight member axis 5046 for both the first and second portions continue to increase until reaching the respective edge 595, 596. Stated another way, the first and second portions 574, 578, when divided along the second weight member axis 5048, each form a substantially trapezoidal shape. By increasing the width 598 of the weight member 550 along the weight member axis 5046 the further away from the geometric center 582, the weight member 550 forms a "bowtie" or a "dog bone" shape. This geometry allows for a greater shift of golf club head 500 center of gravity 512 based on an orientation of the weight member 550 in relation to the golf club head 500, which is discussed in additional detail below.

In other embodiments, the weight member 550 can be any shape including a polygon or a shape with at least one curved surface. For example, the weight member 550 can be circular, rectangular, square, ovular, triangular, or any other shape. Further, the first portion 574 of the weight member 550 can be the same shape as the second portion 578 of the weight member 550, or the first portion 574 of the weight member 550 can be a different shape than the second portion 578 of the weight member 550.

The weight member 550 can be made of titanium, stainless steel, tungsten, aluminum, other metals, composites, metal alloys, polyurethane, reinforced polyurethane, or any other material. Further, the weight member 550 may be made of a single material, more than one material, or of a material with varying composition. The first portion 574 of the weight member may be made of the same material as the second portion 578 of the weight member 550, the first portion 574 of the weight member 550 may be made of a different material than the second portion 578 of the weight member 550, or the first portion 574 of the weight member 550 may be made of a material having a different composition than the second portion 578 of the weight member 550.

Referring to FIG. 8, in the illustrated embodiment, the weight pad 566 includes a thickness 612 and a weight pad center of gravity 620. The weight pad 566 is coupled to (or otherwise mounted on) the first portion 574, on the first side 586 of the weight member 550. The indicator 570 is positioned on the second side 590 of the first portion 574 of the weight member 550 (see FIG. 7). Accordingly, the indicator 570 is positioned on an opposite side of the first portion 574 than the weight pad 566. Generally, the weight pad 566 is formed with the weight member 550. However, in other embodiments the weight pad 566 can be attached, coupled, or otherwise mounted in any suitable manner (e.g., adhesive, weld, fastener, etc.). The weight pad 566 includes a decreasing thickness 612 along the pad 566 from the first edge 595 towards the geometric center 582. However, in other embodiments, the weight pad 566 can have a uniform thickness 612 along the pad 566, or can have an increasing thickness 612 along the pad 566 from the first edge 595 towards the geometric center 582. The weight pad 566 is positioned on a portion of the first portion 574 of the weight member 550. This results in the weight member 550 having more weight on the first portion 574 than on the second portion 578. In other embodiments, the weight pad 566 can be positioned on a majority, up to and including the entirety of the first portion 574 of the weight member 550. In other embodiments, the weight pad 566 can be positioned on the second portion 578 of the weight member 550. In yet other embodiments, a second weight pad (not shown) having a different mass than the weight pad 566 can be positioned on the portion 574, 578 opposite the portion 578, 574 supporting the weight pad 566. The weight pad 566 can be any suitable or desired shape capable of being coupled to the weight member 550.

The weight pad 566 is positioned in an offset arrangement on the first portion 574 of the weight member 550. More specifically, the weight pad 566 is asymmetrical when taken along the weight member axis 5046 as an axis of symmetry. More of the weight pad 566 is positioned on the second side edge 600 of the weight member axis 5046 than on the first side edge 599 of the weight member axis 5046. This offset positioning of the weight pad 566 results in the weight pad center of gravity 620 being positioned offset from the weight member axis 5046. The weight pad 566 may be any suitable or desired shape capable of being coupled to the weight member 550.

The weight pad 566 can be made of titanium, stainless steel, tungsten, aluminum, other metals, composites, metal alloys, polyurethane, reinforced polyurethane, or any other material. The weight pad 566 can be made of the same material as the weight member 550 or the weight pad 566 can be made of a different material than the weight member 550. Further, the weight pad 566 can be made of a single material, a combination of different materials, or a material having varying composition.

Figure 10:
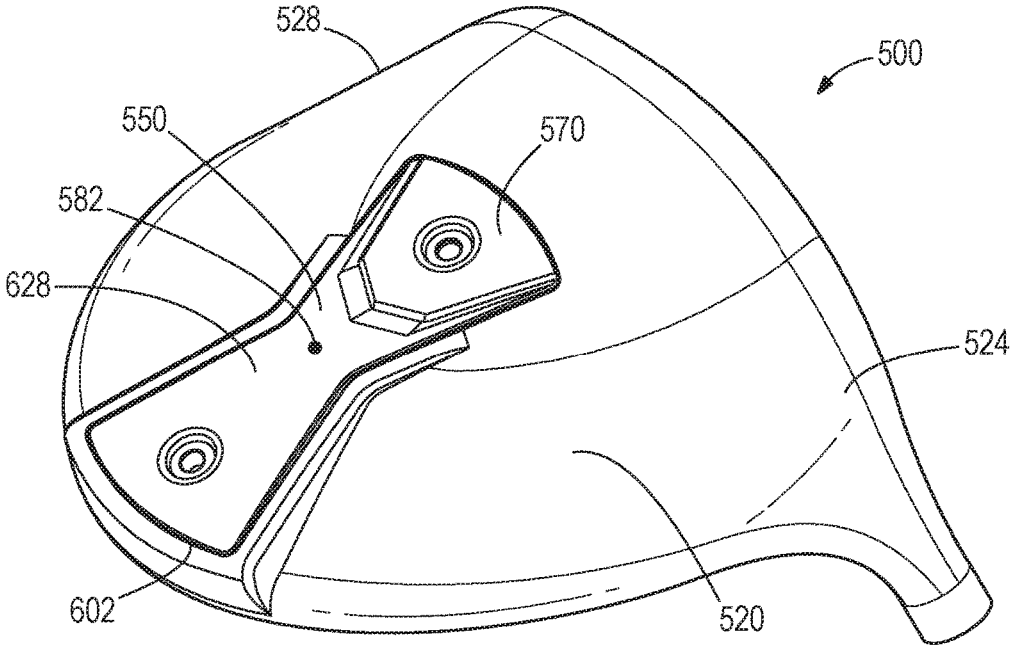
FIG. 10 illustrates a perspective view of the golf club head of FIG. 9.
Figure 11:
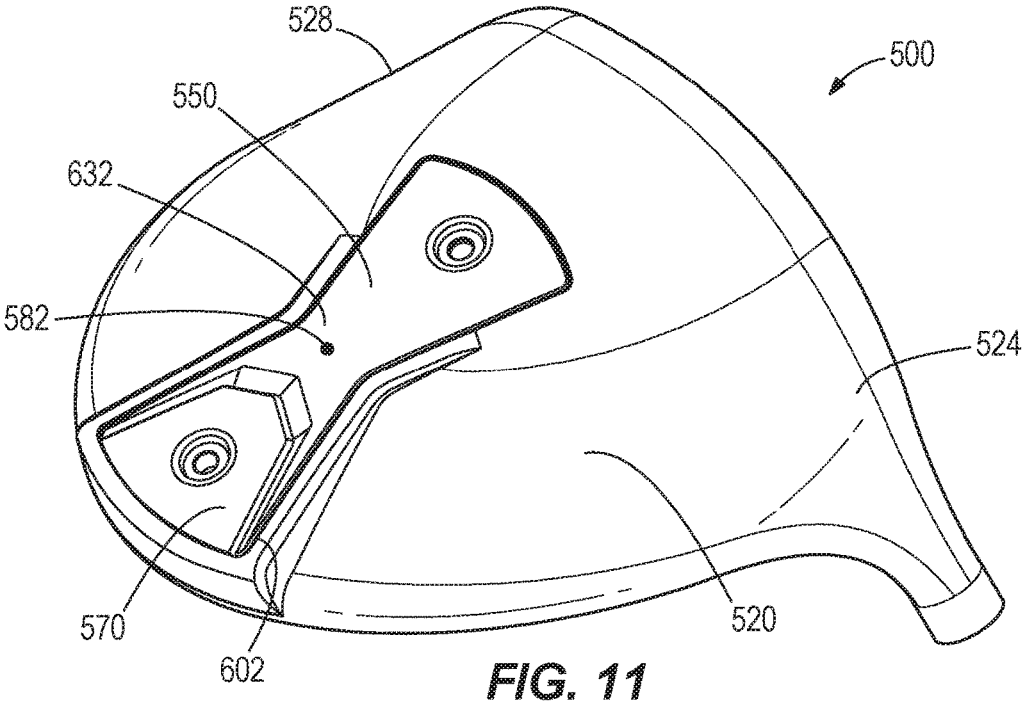
FIG. 11 illustrates another perspective view of the golf club head of FIG. 6.

Referring to FIGS. 10-11, in the illustrated embodiment, the weight member 550 is configured to be removably received within the cavity 602 on the sole portion 520 of the club head 500. The cavity 602 can be any shape capable of or suitable for receiving the weight member 550. For example, the cavity 602 can have the same shape or a complimentary shape as the weight member 550 illustrated in FIGS. 7-8. In other embodiments, the cavity 602 can have a different shape compatible with the shape of the weight member 550, such as a polygon or a shape with at least one curved surface. For example, the cavity 602 can be circular, rectangular, square, ovular, triangular, or any other shape.

Further referring to FIGS. 10-11, in the illustrated embodiment, the weight member 550 is positionable within (or received by or nested in) the cavity 602 such that the first side 586 of the weight member 550, including the weight pad 566, is positioned within (or received by or nested in) the cavity 602 and is in contact with the outer surface 548 of the club head 500. In other words, the weight member 550 is positionable within the cavity 602 such that the second side 590 of the weight member 550 is visible (or exposed) and is flush with the outer surface 548 of the sole portion 520 of the club head 500. The cavity 602 of the weight member 550 can further include a gasket, a rubberized coating, damping tape, or other components capable of reducing noise and vibration. Further, the first side 586 of the weight member 550 can include a gasket, a rubberized coating, damping tape, or other components capable of reducing noise and vibration. When the weight member 550 is positioned within the cavity 602, the indicator 570 is visible. Since the indicator 570 is on the opposing side of the weight member 550 from the weight pad 566, the indicator 570 indicates the position of the weight pad 566.

The weight member 550 is positioned substantially flush with the surface of the sole portion 520 of the golf club. Therefore, the aerodynamic properties of the golf club head 500 are preserved, similar to a golf club head without the weight member 550. Golf club heads having weighting systems, wherein the components are not flush with the sole portion 520 of the club head 500, may generate additional drag forces and disturbed fluid flow around the club head 500 during a swing, thereby slowing the swing speed and decreasing distance of the golf ball 558. The golf club head 500 having the weight member 550, positioned flush with the sole portion 520 of the club head 500 as shown FIGS. 10-11, reduces the aerodynamic drag and disturbed fluid flow associated with non-flush designs, thereby maintaining swing speeds and distance of the golf ball 558.

As illustrated in FIG. 2, the cavity 602 is positioned on the sole portion 520 of the club head 500 such that when the weight member 550 is positioned within the cavity 602, the weight member axis 5046 is positioned at a weight member angle 624 relative to the z-axis 5034. The weight member angle 624 can range from approximately 0 to 20 degrees. For example, the weight member angle 624 can be 0 degrees, 1 degree, 2 degrees, 3 degrees, 4 degrees, 5 degrees, 6 degrees, 7 degrees, 8 degrees, 9 degrees, 10 degrees, 15 degrees, 20 degrees or any other increment of degrees between 0 and 20 degrees. In the illustrated embodiment, the weight member angle 624 is approximately 2 degrees. The weight member 550 is positioned within the cavity 602 a distance $D_1$ to a perimeter 526 of the club head 500. The distance $D_1$ from the weight member 550 to the perimeter 526 at the rear portion 532 of the club head 500 is within 0.400 inches. However, in other embodiments, the distance $D_1$ can be equal to or greater than 0.400 inches.

Referring now to FIGS. 6 and 9-11, the weight member 550 can be positioned and/or repositioned within the cavity 602 in a first position 628 or in a second position 632. To facilitate a removable connection, the weight member 550 can be removably coupled within the cavity 602 in the sole portion 520 using one or more threaded fasteners (not shown). Each threaded fastener can be positioned through a respective through-hole 608 in the first and the second portions 574, 578 of the weight member 550 and/or the weight pad 566, and threaded into a threaded surface (not shown) positioned within the cavity 602. In the illustrated embodiment, the weight member 550 is secured to the golf club head 500 in the cavity 602 using a first threaded fastener positioned through the first portion 574 of the weight member 550 and the weight pad 566, and a second threaded fastener positioned through the second portion 578 of the weight member 550. In other embodiments, the weight member 550 can be secured to the golf club head 500 in the cavity 60 using only the first threaded fastener, positioned through a through-hole (not shown) located near the geometric center 620 of the weight pad 566. Further, the weight member 550 can be secured to the golf club head 500 in the cavity 602 using other fastener types, including, but not limited to, an adhesive, magnets, a snap-fit mechanism, or any other mechanism capable of removably securing the weight member 550 within the cavity 602.

In the illustrated embodiment, the weight member 550 is repositionable by the user. For example, when the weight member 550 is in the first position 628 (shown in FIGS. 9-10), the user can change the position of the weight member 550 to be in the second position 632. This can be done by removing the first and the second threaded fasteners (not shown), removing the weight member 550 from the cavity 602, rotating the weight member 550 180-degrees, repositioning the weight member 550 within the cavity 602, and reengaging the first and the second threaded fasteners (not shown). When the weight member 550 is in the second position 632 (shown in FIGS. 6 and 11), the user can change the position of the weight member 550 to be in the first position 628. This can be done by removing the first and the second threaded fasteners (not shown), removing the weight member 550 from the cavity 602, rotating the weight member 550 180-degrees, repositioning the weight member 550 within the cavity 602, and reengaging the first and the second threaded fasteners. In other embodiments, for example in which the weight member 550 is secured to the cavity 602 using only the first threaded fastener, the position of the weight member 550 can be adjusted by loosening the first threaded fastener, rotating the weight member 550 180-degrees without fully removing the first threaded fastener or the weight member 550 from the cavity 602, and reengaging the first threaded fastener.

Figure 9:
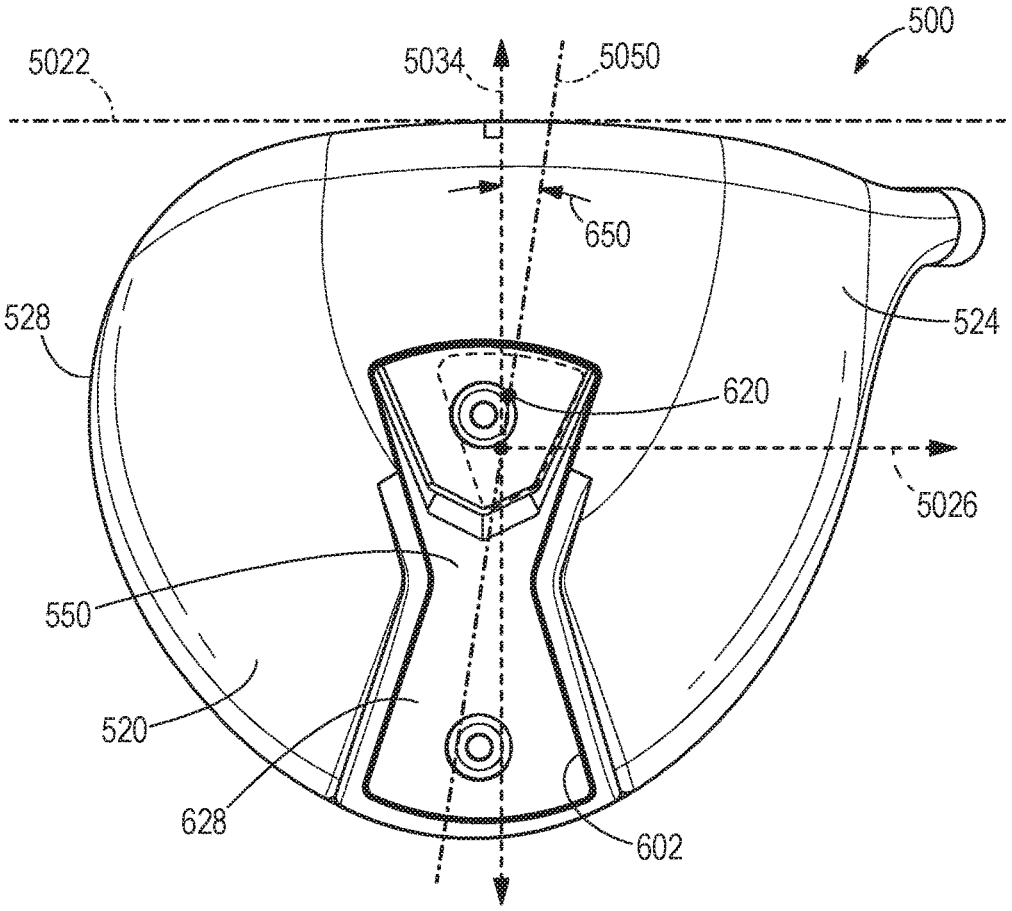
FIG. 9 illustrates another sole view of the golf club head of FIG. 1 with the weight member positioned in a first position and the weight pad shown in broken lines.

Referring now to FIGS. 6 and 9, a weight pad axis 5050 extends between the position of the weight pad center of gravity 620 when the weight member 550 is in the first position 628 (shown in FIG. 9) and the position of the weight pad center of gravity 620 when the weight member 550 is in the second position 632 (shown in FIG. 6). The weight pad axis 5050 is positioned at a weight pad angle 650 relative to the z-axis 5034 when viewed from the sole view of the club head 500. In the illustrated embodiment, the weight pad 566 is positioned offset from the weight member axis 5046 (shown in FIGS. 7-8, shown in broken lines in FIGS. 6 and 9). Therefore, the weight pad angle 650 is different than the weight member angle 624. For example, the weight pad angle 650 can range from approximately 0 to 20 degrees. Specifically, the weight pad angle 650 can be approximately 0 degrees, 1 degree, 5 degrees, 10 degrees, 15 degrees, 20 degrees, or any other angle between 0 and 20 degrees.

The repositionability of the weight member 550 within the cavity 602 of the club head 500 can be used to shift the center of gravity 512 of the club head 500. The club head 500 having the weight member 550 in the first position 628 has a first head center of gravity position $512_1$ and the club head 500 having the weight member 550 in the second position 632 has a second head center of gravity position $512_2$. As shown in FIGS. 3-4, the first head center of gravity position **512*i* is closer to the strikeface 508 and closer to the heel portion 524 of the club head 500 than the second head center of gravity position $\mathbf{512}_2$. In other words, the second head center of gravity position $\mathbf{512}_2$ is closer to the rear portion 532 and closer to the toe portion 528 of the club head 500 than the first head center of gravity position 512***i*. Therefore, the position of the weight member 550 can be used to shift the head center of gravity 512 toward the strikeface 508 and toward the heel portion 524 of the club head 500, or away from the strikeface 508 and toward the toe portion 528 of the club head 500. As shown in FIG. 4, the position of the weight member 550 can change or adjust the position of the center of gravity 512 along the z-axis 5034 (e.g., towards the strikeface 508 or towards the rear portion 532, or a horizontal distance) by a distance or depth Δ. The distance Δ can range from approximately 0.100 inches to approximately 0.300 inches. The position of the weight member 550 can also change or adjust the position of the center of gravity 512 along the y-axis 5030 (e.g., towards the crown portion 522 or towards the sole portion 520, or a vertical distance) by a distance or height of approximately 0.010 inches to approximately 0.050 inches, and more specifically by a distance of approximately 0.015 inches to approximately 0.025 inches.

In other embodiments, the first head center of gravity position $\mathbf{512}_1$ may be closer to the strikeface 508 and closer to the toe portion 528 of the club head 500 than the second head center of gravity position $\mathbf{512}_2$. In other words, the second head center of gravity position $\mathbf{512}_2$ may be closer to the rear portion 532 and closer to the toe portion 528 of the club head 500 than the first head center of gravity position $\mathbf{512}_1$. Therefore, the position of the weight member 550 may be used to shift the head center of gravity 512 toward the strikeface 508 and toward the toe portion 528 of the club head 500, or away from the strikeface 508 and toward the heel portion 524 of the club head 500.

Shifting the head center of gravity 512 may change the moment of inertia of the club head 500 about various axes, including the hosel axis 5010, the x-axis 5026, and the y-axis 5030. The moment of inertia of the club head 500 about a particular axis is a measure of the resistance to rotation of the club head 500 about the particular axis. The moment of inertia of the club head 500 about the particular axis increases as the perpendicular distance from the head center of gravity 512 to the particular axis increases.

Figure 12:
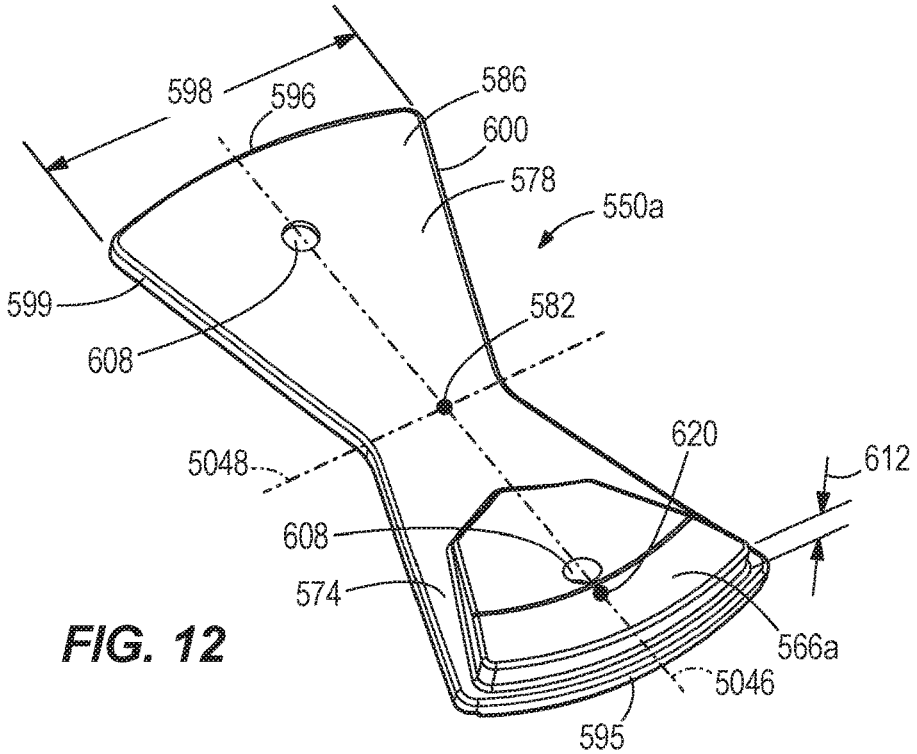
FIG. 12 illustrates a perspective view of another embodiment of a weight member for use with the golf club head of FIG. 1, showing a first side.

Referring now to FIG. 12, an alternative embodiment of the weight member 550*a* having a weight pad 556*a* is illustrated. The weight member 550*a* is substantially the same as the weight member 550, with like numbers referring to like components. In this embodiment, the weight pad 556*a* is positioned in a centered arrangement (i.e., not offset) on the weight member 550*a*. More specifically, the weight pad 566 is symmetrically arranged on the first portion 574 of the weight member 550*a*. More specifically, the weight pad 566*a* is symmetrical when taken along the weight member axis 5046 as an axis of symmetry. This positioning of the weight pad 566 results in the weight pad center of gravity 620 being positioned along the weight member axis 5046.

Figure 13:
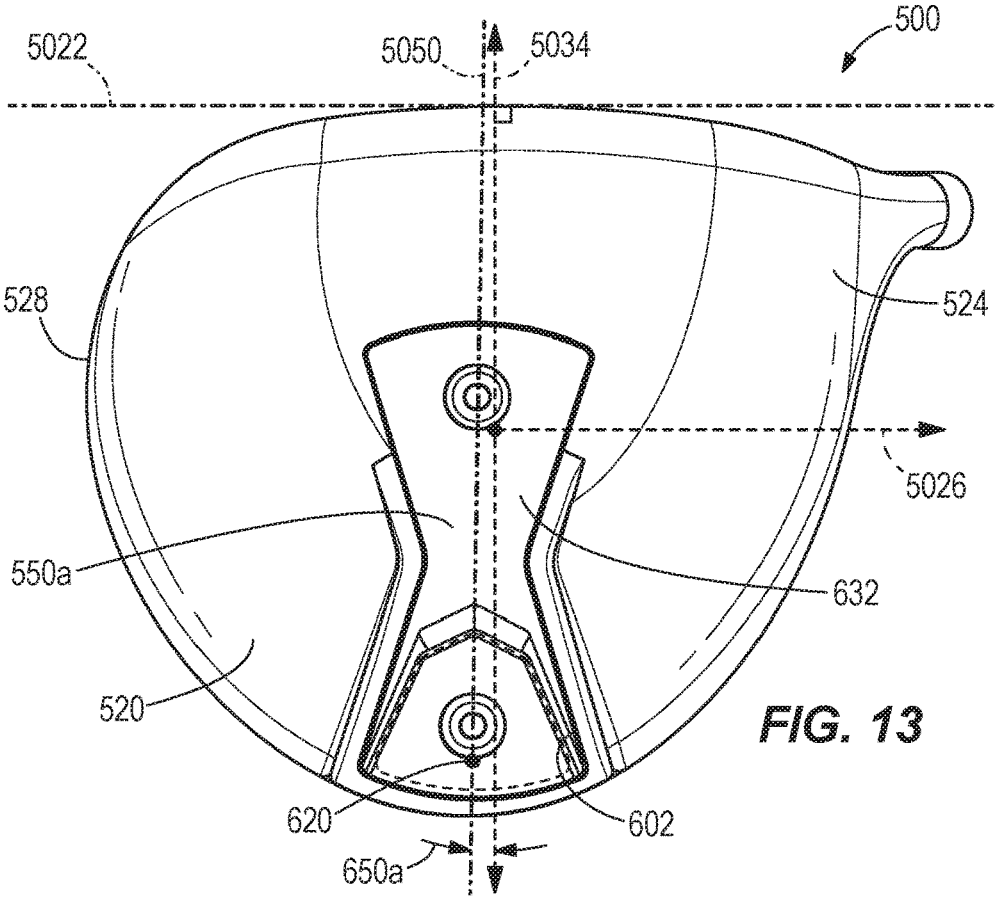
FIG. 13 is another sole view of the golf club head of FIG. 1 with the weight member of FIG. 12 positioned in a second position and the weight pad shown in broken lines.
Figure 14:
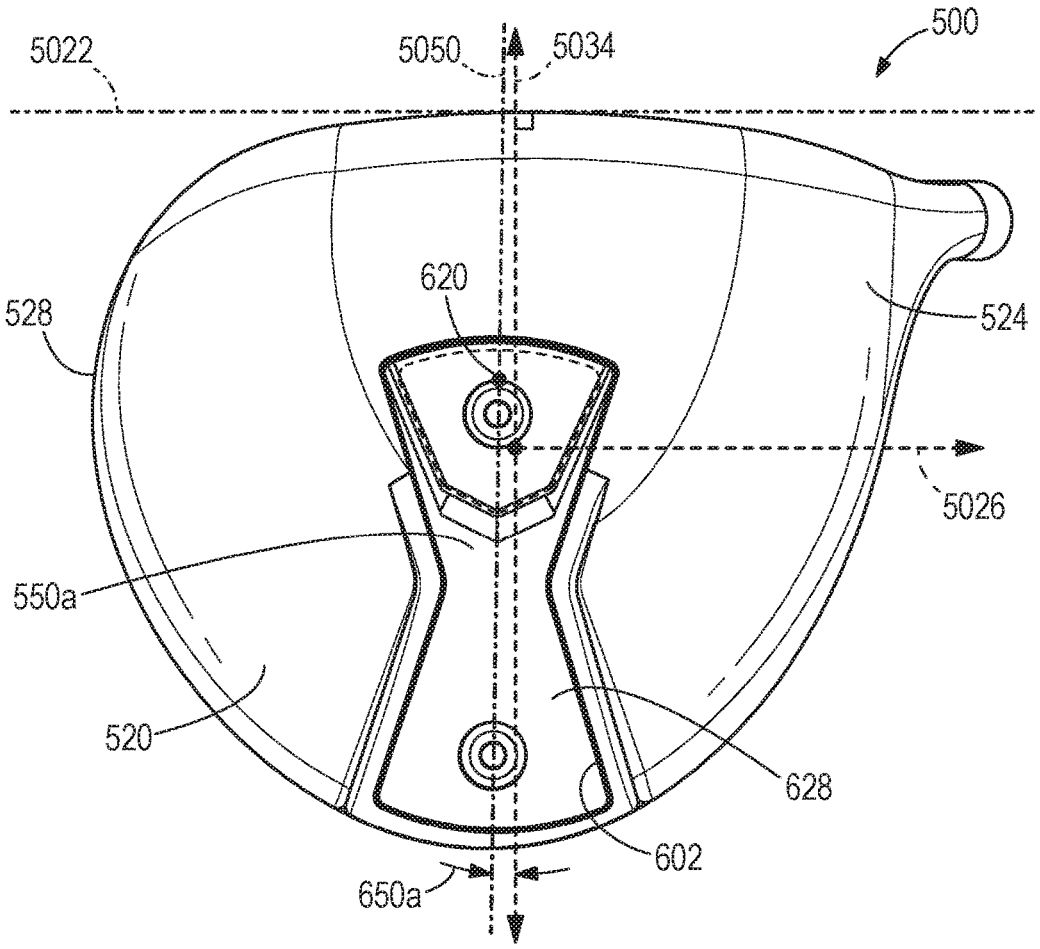
FIG. 14 is another sole view of the golf club head of FIG. 1 with the weight member of FIG. 12 positioned in a first position and the weight pad shown in broken lines.

FIGS. 13-14 illustrate the weight member 550*a* positioned in the cavity 602 in the first position 628 (FIG. 14) and the second position 632 (FIG. 13). The weight pad axis 5050 extends between the position of the weight pad center of gravity 620 when the weight member 550*a* is in the first position 628 (shown in FIG. 14) and the position of the weight pad center of gravity 620 when the weight member 550*a* is in the second position 632 (shown in FIG. 13). The weight pad axis 5050 is positioned at the weight pad angle 650 relative to the z-axis 5034 when viewed from the sole view of the club head 500. The weight pad 566*a* (shown in broken lines) is also positioned along the weight member axis 5046 (shown in FIG. 2). Stated another way, the weight pad axis 5050 and the weight member axis 5046 (shown in FIG. 2) generally overlap. Therefore, the weight pad angle 650*a* is approximately the same as the weight member angle 624 (FIG. 2). The weight pad angle 650*a* can range from approximately 0 to 20 degrees. Specifically, the weight pad angle 650*a* can be approximately 0 degrees, 1 degree, 5 degrees, 10 degrees, 15 degrees, 20 degrees, or any other angle between 0 and 20 degrees.

The club head 500 having the weight member 550, 550*a* in the first position 628 (shown in FIGS. 9, 10, and 14) has a first moment of inertia about the hosel axis 5010, a first moment of inertia about the x-axis 5026, and a first moment of inertia about the y-axis 5030. The club head 500 having the weight member 550, 550*a* in the second position 632 (shown in FIGS. 6, 11, and 13) has a second moment of inertia about the hosel axis 5010, a second moment of inertia about the x-axis 5026, and a second moment of inertia about the y-axis 5030.

In the illustrated embodiments, the first moment of inertia of the club head 500 about the hosel axis 5010 is less than the second moment of inertia of the club head 500 about the hosel axis 5010 because the perpendicular distance from the first center of gravity position to the hosel axis 5010 is less than the perpendicular distance from the second center of gravity position to the hosel axis 5010. Further, the first moment of inertia of the club head 500 about the y-axis 5030 is less than the second moment of inertia of the club head 500 about the y-axis 5030 because the perpendicular distance from the first center of gravity position to the y-axis 5030 is less than the perpendicular distance from the second center of gravity position to the y-axis 5030. Further still, the first moment of inertia of the club head 500 about the x-axis 5026 may be greater than or may be less than the second moment of inertia of the club head 500 about the y-axis 5030 because the perpendicular distance from the first center of gravity position to the x-axis 5026 may be greater than or may be less than the perpendicular distance from the second center of gravity position to the x-axis 5026.

Shifting the center of gravity of the club head 500, thereby changing the moment of inertia of the club head 500 about the hosel axis 5010, the x-axis 5026, and/or the y-axis 5030, may change the performance characteristics of the golf club during a swing, at impact with a golf ball 558, or a combination of both (i.e., during a swing and at impact with the golf ball 558). During a swing, the club head 500 rotates about the hosel axis 5010 to square the strikeface 508 at impact with the golf ball 558. Squaring the strikeface 508 during a swing promotes the desired ball direction. At impact, the position of contact with the golf ball 558 on the strikeface 508, relative to the head center of gravity 512, affects the spin of the golf ball 558 (i.e., the gear effect).

For example, impact of the golf ball 558 on the strikeface 508, offset from the head center of gravity 512 in the direction of the x-axis 5026, causes the club head 500 to rotate about the y-axis 5030 in a first direction and the golf ball 558 to spin about the second axis 5042 in a second direction opposite the first direction. Spin of the golf ball 558 about the second axis 5042 corresponds to horizontal spin of the golf ball 558, which affects the fade or draw of the golf ball 558. Similarly, impact of the golf ball 558 on the strikeface 508, offset from the head center of gravity 512 in the direction of the y-axis 5030, causes the club head 500 to rotate about the x-axis 5026 in a third direction and the golf ball 558 to spin about the first axis 5038 in a fourth direction opposite the third direction. Spin of the golf ball 558 about the first axis 5038 corresponds to vertical spin of the golf ball 558, which affects the height and distance of the golf ball 558.

Shifting the center of gravity of the club head 500 may change the performance characteristics of the golf club during a swing by changing the moment of inertia of the club head 500 about the hosel axis 5010. The moment of inertia of the club head 500 about the hosel axis 5010 corresponds to the resistance of the club head 500 to rotate about the hosel axis 5010 during a swing. The club head 500 having the weight member 550, 550*a* in the first position 628, having the first moment of inertia about the hosel axis 5010, has a lower resistance to rotation about the hosel axis 5010 during a swing than the club head 500 having the weight member 550, 550*a* in the second position 632. Therefore, the club head 500 having the weight member 550, 550*a* in the first position 628 is easier to rotate during a swing to square the strikeface 508 at impact than the club head 500 having the weight member 550, 550*a* in the second position 632. Conversely, the club head 500 having the weight member 550, 550*a* in the second position 632, having the second moment of inertia about the hosel axis 5010, has a greater resistance to rotation about the hosel axis 5010 during a swing then the club head 500 having the weight member 550, 550*a* in the first position 628. Therefore, the club head 500 having the weight member 550, 550*a* in the second position 632 is more difficult to rotate during a swing to square the strikeface 508 at impact than the club head 500 having the weight member 550, 550*a* in the first position 628.

Shifting the center of gravity of the club head 500 may change the performance characteristics of the golf club at impact with the golf ball 558 by changing the moment of inertia of the club head 500 about at least one of the x-axis 5026 or the y-axis 5030. The moment of inertia of the club head 500 about the y-axis 5030 corresponds to horizontal spin on the golf ball 558 at impact at a particular location. The club head 500 having the weight member 550, 550*a* in the first position 628, with the first moment of inertia about the y-axis 5030, has a lower resistance to rotation about the y-axis 5030 at impact with the golf ball 558 than the club head 500 having the weight member 550, 550*a* in the second position 632. The lower resistance to rotation corresponds to increased rotation about the y-axis 5030 of the club head 500 having the weight member 550, 550*a* in the first position 628 at impact with the golf ball 558. Increased rotation of the club head 500 about the y-axis 5030 at impact corresponds to increased horizontal spin on the golf ball 558 due to the gear effect, leading to greater fade or draw in the golf ball 558. Therefore, the club head 500 having the weight member 550, 550*a* in the first position 628 is less forgiving than the club head 500 having the weight member 550, 550*a* in the second position 632.

Conversely, the club head 500 having the weight member 550, 550*a* in the second position 632, with the second moment of inertia about the y-axis 5030, has a higher resistance to rotation about the y-axis 5030 at impact with the golf ball 558 than the club head 500 having the weight member 550, 550*a* in the first position 628. The higher resistance to rotation corresponds to reduced rotation about the y-axis 5030 of the club head 500 having the weight member 550, 550*a* in the second position 632 at impact with the golf ball 558. Reduced rotation of the club head 500 about the y-axis 5030 at impact corresponds to reduced horizontal spin on the golf ball 558 due to the gear effect, leading to reduced fade or draw in the golf ball 558. Therefore, the club head 500 having the weight member 550, 550*a* in the second position 632 is more forgiving than the club head 500 having the weight member 550, 550*a* in the first position 628.

The moment of inertia of the club head 500 about the x-axis 5026 corresponds to vertical spin of the golf ball 558 at impact at a particular location. The club head 500 having the weight member 550, 550*a* in the first position 628 may have the first head center of gravity position $\mathbf{512}_1$ closer to the crown portion 522 or closer to the sole portion 520 than the second head center of gravity position $\mathbf{512}_2$ of the club head 500 having the weight member 550, 550*a* in the second position 632. Therefore, the club head 500 having the weight member 550, 550*a* in the first position 628, with the first moment of inertia about the x-axis 5026 may have a greater or lower resistance to rotation about the x-axis 5026 axis at impact with the golf ball 558. The difference in position of the head center of gravity 512 in the direction of the y-axis 5030 results in a difference in the moment of inertia about the x-axis 5026, leading to a difference in vertical spin on the golf ball 558 during impact at a particular location on the strikeface 508.

The club head 500 having the weight member 550, 550*a* in the first position 628 results in a first vertical spin rate and a first horizontal spin rate of the golf ball 558 on impact at the geometric center 554 of the strikeface 508. The club head 500 having the weight member 550, 550*a* in the second position 632 results in a second vertical spin rate and a second horizontal spin rate of the golf ball 558 on impact at the geometric center 554 of the strikeface 508.

In the illustrated embodiment, the first vertical spin rate is different than the second vertical spin rate, the first horizontal spin rate is approximately zero, and the second horizontal spin rate is approximately zero. Therefore, the user may adjust the position of the weight member 550, 550*a* from the first position 628 to the second position 632 or from the second position 632 to the first position 628 to achieve a predetermined difference in vertical spin rate applied to the golf ball 558, while negligibly affecting the horizontal spin rate of the golf ball 558. The difference between the first vertical spin rate and the second vertical spin rate may range from approximately 200 to 600 revolutions per minute (rpm). For example, the difference between the first vertical spin rate and the second vertical spin rate may be approximately 200 rpm, 300 rpm, 400 rpm, 500 rpm, or 600 rpm. In the illustrated embodiment, the difference between the first vertical spin rate and the second vertical spin rate may be approximately 300 rpm.

Because it can be desirable to affect the vertical spin rate of the golf ball 558 and/or direction the club head 500 applies to the golf ball 558 while minimally and/or negligibly affecting the horizontal spin rate and/or direction the club head 500 applies to the golf ball 558, the weight member 550, 550*a* can be configured to compensate for effects on the horizontal spin rate and/or direction the club head 500 applies to the golf ball 558 when the weight member 550, 550*a* is adjusted between the first and the second positions 628, 632. As a result, the horizontal spin rate and/or direction the club head 500 applies to the golf ball 558 when the weight member 550, 550*a* is adjusted between the first and the second positions 628, 632 can remain approximately constant. Thus, when the fade and/or draw bias is approximately zero (e.g., less than 50 rpm, and more specifically less than 25 rpm, and more specifically less than 10 rpm, etc.) for a particular position of the weight member 550, 550*a*, the fade and/or draw bias can remain approximately zero (e.g., less than 50 rpm, and more specifically less than 25 rpm, and more specifically less than 10 rpm, etc.) for other positions of the weight member 550, 550*a*.

The weight member 550, 550*a* may be used to change the vertical spin rate of the golf ball 558 while negligibly affecting the horizontal spin rate and/or direction the club head 500 applies to the golf ball 558 by modifying the weight pad angle 650 as determined through testing of the club head 500. Many factors may affect the horizontal spin rate of the golf ball 558. For example, when the club head 500 impacts the golf ball 558 at the geometric center 554 of the strikeface 508, the club head 500 may apply a horizontal spin on the golf ball 558 due to various factors, including: the head center of gravity 512; the moment of inertia of the club head 500 about the hosel axis 5010; the moment of inertia about the y-axis 5030; and the centrifugal force on the club head 500 during a swing. Therefore, testing club heads 500 with varying weight pad angles 650 may be implemented to determine the appropriate weight pad angle 650 that changes the vertical spin rate of the golf ball 558 in a predetermined manner while negligibly affecting the horizontal spin rate of the golf ball 558 and/or direction the club head 500 applies to the golf ball 558.

In the illustrated embodiment, testing as described above was implemented to determine the weight pad angle 650 able to minimize the effects on the horizontal spin rate and/or direction the club head 500 applies to the golf ball 558 while changing the vertical spin rate of the golf ball 558. In one embodiment, the weight pad angle 650, determined during testing, is approximately 2 degrees. The weight pad angle 650 may range from approximately 0 to 20 degrees. For example, the weight pad angle 650 may be approximately 0 degrees, 1 degree, 2 degrees, 3 degrees, 4 degrees, 5 degrees, 6 degrees, 7 degrees, 8 degrees, 9 degrees, 10 degrees, 15 degrees, 20 degrees, or any other increment of degree between 0 and 20 degrees.

By allowing the user to adjust (i.e., increase and/or decrease) the vertical spin rate and/or the horizontal spin rate of the golf club as applied by the club head 500 based on playing conditions and/or the user's swing, the weight member 550, 550*a* can give the user more control over the flight path of the golf ball 558 in general and can give the user the ability to fine tune the club head 500. Adjustments (i.e., an increase and/or decrease) to the vertical spin rate and/or horizontal spin rate applied by the club head 500 to the golf ball 558 can be made in real time during and/or before a round of golf.

For example, in the illustrated embodiment, when the play condition is windy, the weight member 550, 550*a* can be adjusted to a position to decrease the vertical spin rate applied to the golf ball 558 so that the wind has less effect on the flight path of the golf ball 558. Further, in the illustrated embodiment, when the playing condition is wet and/or humid, the weight member 550, 550*a* can be adjusted to a position to increase the vertical spin rate applied to a golf ball 558 and, therefore, the upward lift on the golf ball 558, to compensate for the decreased air density resulting from the wet and/or humid playing conditions. The increased vertical spin rate can also compensate for aerodynamic drag resulting from accumulated moisture on the golf ball 558.

The weight member 550, 550*a* may be sold as part of a golf club, as a standalone item, or in a set having a variety of options. The set of weight members may include weight members 550, 550*a* that vary with material of the weight member 550, 550*a*, material of the weight pad 566, 566*a*, size of the weight member 550, 550*a*, size of the weight pad 566, 566*a*, shape of the weight member 550, 550*a*, shape of the weight pad 566, 566*a*, composition of the weight member 550, 550*a*, composition of the weight pad 566, 566*a*, position of the weight pad 566, 566*a* on the weight member 550, 550*a*, or any combination of the described variations.

For example, the set of weight members may include weight members 550, 550*a* having weight pads 566, 566*a* of increasing size to achieve varying degrees of adjustment in the center of gravity of the club head 500, or the set of weight members 550, 550*a* may include weight members 550, 550*a* having weight pads 566, 566*a* with materials of varying densities to achieve varying degrees of adjustment in the center of gravity of the club head 500.

The set of weight members may have any number of weight members 550, 550*a* including 1, 2, 3, 4, 5, or any number of weight members 550, 550*a* greater than 5. Further, the weight pad 566 may be removable from the weight member 550, 550*a* and replaceable with a different weight pad 566, 566*a* having a different weight, size, material, or composition.

Figure 15:
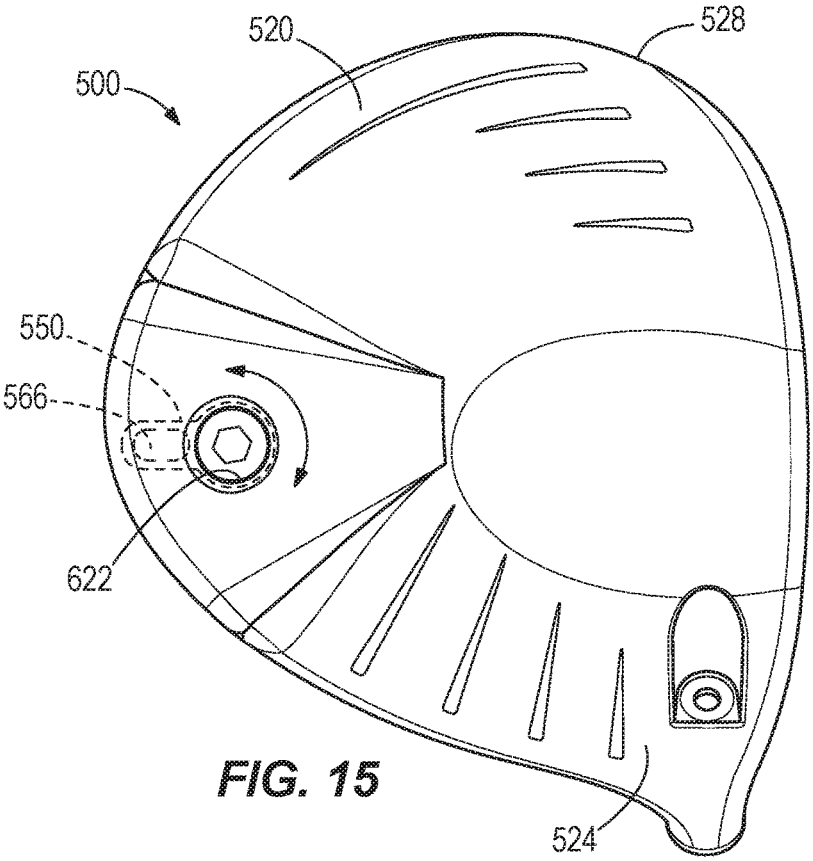
FIG. 15 illustrates a perspective view of another embodiment of the golf club head of FIG. 1.
Figure 16:
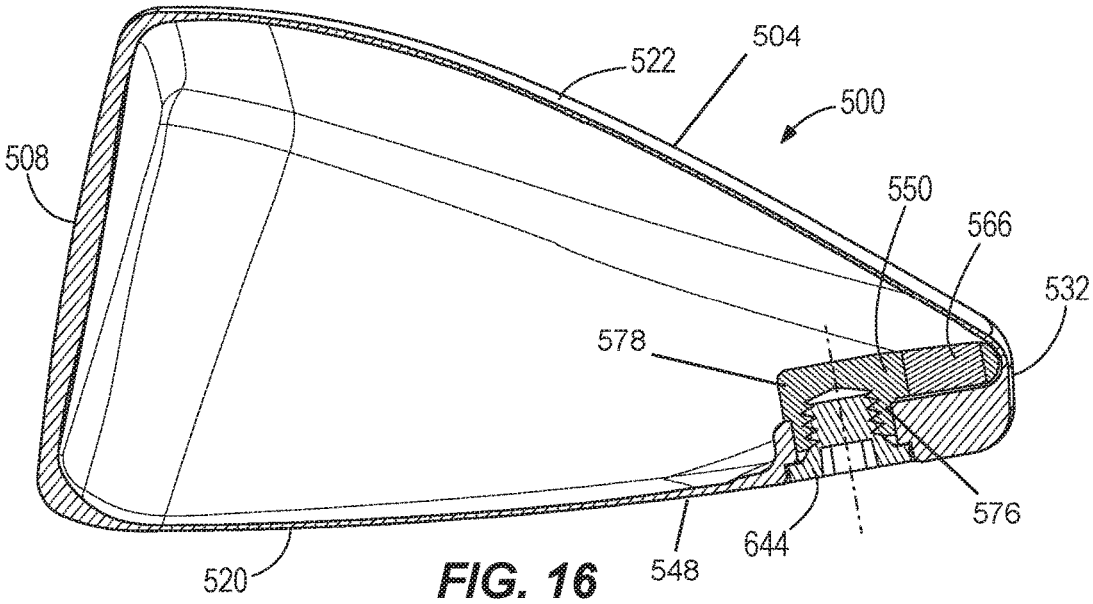
FIG. 16 illustrates a section view of the golf club head of FIG. 11.

FIGS. 15-16 illustrate another embodiment of the weight member 550. The weight member 550 illustrated in FIGS. 15-16 may be substantially similar to the weight member 550 shown in FIG. 7-8, or 550*a* shown in FIG. 12. The weight member 550 illustrated in FIGS. 15-16 further includes a collar coupled to the second portion 578 of the weight member 550 and a recess 576 positioned in the second portion 578 of the weight member 550. The recess 576 may have threads capable of receiving a threaded fastener 644.

The weight member 550 illustrated in FIGS. 15-16 is positioned adjacent to the inner surface of the club head 500. In this embodiment, the sole portion 520 of the club head 500 may not include the cavity 602. Rather, the sole portion 520 of the club head 500 may include a through-hole 622 capable of positioning the weight member 550 within the club head 500 such that the weight member 550 is adjustable from the outside of the club head 500.

The club head 500 having the weight member 550 may be assembled by positioning the weight member 550 having the collar within the body 504 of the club head 500, positioning the threaded fastener 644 through the through-hole 622 in the sole portion 520 of the club head 500 from the outer surface 548, through the collar, and into the threaded recess 576 of the weight member 550.

In other embodiments, the weight member 550 may be coupled to the club head 500 using mechanisms other than the threaded fastener 644, including a magnetic fastener, a press fit mechanism, or any other mechanism capable of coupling the weight member 550 to the body 504 of the club head 500 while allowing repositioning of the weight member 550 by the user. Further, the weight member 550 may include a gasket, a rubberized coating, damping tape, or other components capable of reducing noise.

The weight member 550 may be adjusted by loosening the threaded fastener 644 while the collar remains stationary, rotating the weight member 550 clockwise or counterclockwise using the collar, and tightening the threaded fastener 644 while the collar remains stationary.

Referring to FIGS. 15-16, the weight member 550 may rotate within the club head 500 between 0 and 360 degrees or a between a smaller range of degrees relative to a starting position of the weight member 550. The weight member 550 may be secured in position at any angle between 0 and 360 degrees for club performance as described above. The ability of the user to adjust the position of the weight member 550 as described above allows the user to adjust the center of gravity of the club head 500 toward the strikeface 508, away from the strikeface 508, toward the heel portion 524, toward the toe portion 528, or in any combination of the described configurations including; toward the strikeface 508 and toward the heel portion 524, toward the strikeface 508 and toward the toe portion 528, away from the strikeface 508 and toward the heel portion 524, or away from the strikeface 508 and toward the toe portion 528. Further, the weight member 550 shown in FIGS. 15-16 may be secured to achieve varying degrees of any of the above configurations.

In the illustrated embodiments, the golf club head 500 having the weight member 550, 550*a* is a driver-type club head. It should be appreciated that the driver is provided for purposes of illustration of one or more embodiments of the weight member 550, 550*a*. In other embodiments, the weight member 550, 550*a* can be used on any desired golf club, for example, a wood-type golf club head (e.g. a driver club head, a fairway wood club head, a hybrid club head, etc.), an iron golf club head, a wedge golf club head, and/or a putter golf club head. In addition, the golf club head 500 can have a loft that can range from approximately 3 degrees to approximately 65 degrees (including, but not limited to, 3, 3.5, 4, 4.5, 5, 5.5, 6, 6.5, 7, 7.5, 8, 8.5, 9, 9.5, 10, 10.5, 11, 11.5, 12, 12.5, 13, 13.5, 14, 14.5, 15, 15.5, 16, 16.5, 17, 17.5, 18, 18.5, 19, 19.5, 20, 20.5, 21, 21.5, 22, 22.5, 23, 23.5, 24, 24.5, 25, 25.5, 26, 26.5, 27, 27.5, 28, 28.5, 29, 29.5, 30, 30.5, 31, 31.5, 32, 32.5, 33, 33.5, 34, 34.5, 35, 35.5, 36, 36.5, 37, 37.5, 38, 38.5, 39, 39.5, 40, 40.5, 41, 41.5, 42, 42.5, 43, 43.5, 44, 44.5, 45, 45.5, 46, 46.5, 47, 47.5, 48, 48.5, 49, 49.5, 50, 50.5, 51, 51.5, 52, 52.5, 53, 53.5, 54, 54.5, 55, 55.5, 56, 56.5, 57, 57.5, 58, 58.5, 59, 59.5, 60, 60.5, 61. 61.5, 62, 62.5, 63, 63.5, 64, 64.5, and/or 65 degrees). The golf club head 500 having the weight member 550, 550*a* disclosed herein has a volume of at least 400 cubic centimeters (cc), and preferably equal to or more than 400 cc. However, in other embodiments, the golf club head 500 can be less than 400 cc (e.g., a fairway wood, a hybrid, etc.).

In embodiments in which the club head 500 is a driver-type golf club head, the driver has a head mass, which includes the combined mass of the club head 500 and the weight 550, 550*a*, of approximately 200 grams to approximately 215 grams. The weight 550, 550*a* has a mass of approximately 10 grams to approximately 40 grams. Accordingly, the weight 550, 550*a* is approximately 4.6% to approximately 20.0% of the head mass.

In embodiments where the club head 500 is a fairway wood-type golf club head, the fairway wood has a head mass, which includes the combined mass of the club head 500 and the weight 550, 550*a*, of approximately 210 grams to approximately 240 grams. The weight 550, 550*a* has a mass of approximately 10 grams to approximately 40 grams. Accordingly, the weight 550, 550*a* is approximately 4.2% to approximately 19.0% of the head mass.

Clause 1: A golf club head comprising a body having a heel portion, a toe portion, a sole portion, and an outer surface; a strikeface having a geometric center; a head center of gravity; and a weight member including a weight pad, the weight member is configured to be positioned adjacent to the sole portion of the club head, substantially flush with the outer surface of the body, and the weight member is repositionable by the user to a first position or a second position, wherein the club head having the weight member in the first position shifts the head center of gravity toward the strikeface, and the club head having the weight member in the second position shifts the head center of gravity away from the strikeface, such that on impact with a golf ball at the geometric center of the strikeface, the club head having the weight member in the first position applies a first vertical spin on the golf ball and the club head having the weight member in the second position applies a second vertical spin on the golf ball such that the second vertical spin is different than the first vertical spin.

Clause 2: The golf club head of clause 1, wherein the difference between the first vertical spin rate and the second vertical spin rate ranges from approximately 200 rpm to 600 rpm.

Clause 3: The golf club head of clause 1, wherein the difference between the first vertical spin rate and the second vertical spin rate is approximately 300 rpm.

Clause 4: The golf club head of claim 1, wherein when the weight member is in the first position on impact with a golf ball at the geometric center of the strikeface the club head applies a first horizontal spin on the golf ball and when the weight member is in the second position on impact with a golf ball at the geometric center of the strikeface the club head applies a second horizontal spin on the golf ball, such that the second horizontal spin and the first horizontal spin are each less than 10 rpm.

Clause 5: The golf club head of clause 1, wherein the weight member is made of titanium, stainless steel, tungsten, aluminum, other metals, composites, metal alloys, polyurethane, reinforced polyurethane, or a different material.

Clause 6: The golf club head of clause 1, wherein the weight pad is made of titanium, stainless steel, tungsten, aluminum, other metals, composites, metal alloys, polyurethane, reinforced polyurethane, or a different material.

Clause 7: The golf club head of clause 1, wherein the weight member and the pad member are made of the same material.

Clause 8: The golf club head of clause 1, wherein the weight member is removably coupled to the sole portion using at least one threaded fastener.

Clause 9: The golf club head of clause 1, wherein the weight member includes an indicator to indicate the position of the weight pad.

Clause 10: The golf club head of clause 1, wherein when the weight member is in the first position, the head center of gravity is closer to the heel portion than when the weight member is in the second position.

Clause 11: The golf club head of clause 1, wherein when the weight member is in the first position, the head center of gravity is closer to the toe portion than when the weight member is in the second position.

Clause 12: The golf club head of clause 1, wherein when the weight member is in the second position, the head center of gravity is closer to the heel portion than when the weight member is in the first position.

Clause 13: The golf club head of clause 1, wherein when the weight member is in the second position, the head center of gravity is closer to the toe portion than when the weight member is in the first position.

Clause 14: The golf club head of clause 1, wherein the weight pad has a thickness that is constant along a length of the weight member.

Clause 15: The golf club head of clause 1, wherein the thickness of the weight pad varies along a length of the weight member.

Clause 16: A golf club head comprising a body having a heel portion, a toe portion, a sole portion, and an outer surface, a strikeface having a geometric center, a head center of gravity, and a weight member having opposing first and second edges and including a weight member axis and a geometric center, the weight member axis intersecting the first and second edges and the geometric center, wherein a width of the weight member in a direction taken orthogonal to the weight member axis increases along the weight member axis from the geometric center towards the first and second edges.

Clause 17: The golf club head of clause 16, further comprising a rear portion opposite the strikeface, and a perimeter partially defined by the strikeface and the sole portion, wherein the weight member is positioned on the sole portion a first distance from the perimeter, wherein the first distance is greater than or equal to 0.400 inches.

Clause 18: The golf club head of clause 16, wherein the golf club head and the weight member together have a combined total mass, and wherein the weight member has a first mass ranging from 4.2% to 20.0% of the total mass.

Clause 19: The golf club head of clause 16, wherein the weight member includes a first portion that includes the first edge, a second portion that includes the second edge, and a weight pad positioned on the first portion, the weight pad being symmetrical about the weight member axis.

Clause 20: A golf club head comprising a body having a heel portion, a toe portion, a sole portion, and an outer surface, a strikeface having a geometric center, a rear portion opposite the strikeface, a head center of gravity, a club head axis that extends through the head center of gravity from the strikeface to the rear portion, and a weight member including a weight pad, the weight pad having a center of gravity, wherein the weight member is configured to be positioned adjacent to the sole portion of the club head in one of a first position or a second position, wherein the position of the weight pad center of gravity changes in relation to the strikeface between the first and second positions, wherein a weight pad axis fixed with respect to the club head axis extends through the weight pad center of gravity when the weight member is in the first position and when the weight member is in the second position, and wherein the weight pad axis and the club head axis form a weight pad angle that ranges from 0 degrees to 20 degrees.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

The invention claimed is:

1. A golf club head comprising:

a body having a heel portion, a toe portion, a sole portion, and an outer surface;

a strikeface having a geometric center;

a head center of gravity; and a weight member having opposing first and second ends; wherein the weight member is configured to be positioned adjacent to the sole portion of the club head, substantially flush with the outer surface of the body;

the weight member is repositionable by the user to a first position or a second position;

a weight member axis extends through a geometric center of the weight member, longitudinally and symmetrically dividing a width of the weight member along the entire length, the weight member comprises a weight member axis that forms a weight member angle relative to a z-axis extending through the head center of gravity from the strikeface to the rear portion parallel to a ground plane when the club head is at an address position and the z-axis is perpendicular to the strikeface, the weight member angle ranges from 3 to 20 degrees, the weight member comprises a weight pad, and the weight pad is asymmetric with respect to the weight member axis; wherein the club head having the weight member in the first position shifts the head center of gravity toward the strikeface, and the club head having the weight member in the second position shifts the head center of gravity away from the strikeface, such that on impact with a golf ball at the geometric center of the strikeface, the club head having the weight member in the first position applies a first vertical spin on the golf ball and the club head having the weight member in the second position applies a second vertical spin on the golf ball such that the second vertical spin is different than the first vertical spin.

2. The golf club head of claim 1, wherein the weight member angle is between 3 and 15 degrees.

3. The golf club head of claim 1, wherein the weight member angle is between 5 and 10 degrees.

4. The golf club head of claim 1, wherein the weight member angle is between 10 and 20 degrees.

5. The golf club head of claim 1, wherein the difference between the first vertical spin rate and the second vertical spin rate ranges from approximately 200 rpm to 600 rpm.

6. The golf club head of claim 1, wherein when the weight member is in the first position on impact with a golf ball at the geometric center of the strikeface the club head applies a first horizontal spin on the golf ball and when the weight member is in the second position on impact with a golf ball at the geometric center of the strikeface the club head applies a second horizontal spin on the golf ball, such that the second horizontal spin and the first horizontal spin are each less than 10 rpm.

7. The golf club head of claim 1, wherein the weight member is removably coupled to the sole portion using at least one threaded fastener.

8. The golf club head of claim 1, wherein the weight member includes an indicator to indicate the position of the weight pad with respect to the body.

9. The golf club head of claim 1, wherein the golf club head and the weight member together have a combined total mass, and wherein the weight member has a first mass ranging from 4.2% to 20.0% of the total mass.

* * * * *